US007090033B2

(12) United States Patent
Chan et al.

(10) Patent No.: US 7,090,033 B2
(45) Date of Patent: Aug. 15, 2006

(54) DRILL STRING SHUTOFF VALVE

(75) Inventors: Kwong-Onn C. Chan, Edmonton (CA); Behrooz Movaffagh, Edmonton (CA); Xiaoping He, Edmonton (CA)

(73) Assignee: Vetco Gray Inc., Houston, TX (US)

( * ) Notice: Subject to any disclaimer, the term of this patent is extended or adjusted under 35 U.S.C. 154(b) by 186 days.

(21) Appl. No.: 10/677,917

(22) Filed: Oct. 2, 2003

(65) Prior Publication Data

US 2004/0112644 A1 Jun. 17, 2004

Related U.S. Application Data

(63) Continuation-in-part of application No. 10/321,087, filed on Dec. 17, 2002, now Pat. No. 6,918,452.

(51) Int. Cl.
*E21B 21/08* (2006.01)

(52) U.S. Cl. ..... 175/25; 175/38; 175/318

(58) Field of Classification Search ..... 166/319, 166/321, 386; 175/38, 57, 92, 296, 317, 175/318

See application file for complete search history.

(56) References Cited

U.S. PATENT DOCUMENTS

| | | | | |
|---|---|---|---|---|
| 3,970,335 | A * | 7/1976 | Curington et al. | 285/123.3 |
| 4,462,472 | A * | 7/1984 | Beimgraben | 175/320 |
| 4,936,397 | A * | 6/1990 | McDonald et al. | 175/26 |
| 6,601,652 | B1 * | 8/2003 | Moore et al. | 166/381 |
| 6,935,423 | B1 * | 8/2005 | Kusmer | 166/217 |

* cited by examiner

*Primary Examiner*—Zakiya W. Bates
(74) *Attorney, Agent, or Firm*—Bracewell & Giuliani LLP

(57) ABSTRACT

A valve assembly connects into a drill string for opening and closing at least one inner passage within the drill string of the drill string. The valve assembly includes an annular valve assembly carried in an annular passage that moves between the open and closed positions in response to downward fluid pressure from the surface through the annular passage. The valve assembly also includes an inner valve assembly carried in an inner passage of the drill string. The inner valve assembly is a two-way valve that is actuated between open and closed positions by pressure pulses from the surface through the inner passage. The valve assembly can be used within coiled tubing.

22 Claims, 7 Drawing Sheets

DRILL STRING SHUTOFF VALVE

RELATED APPLICATIONS

This continuation-in-part patent application claims the benefit of co-pending, non-provisional patent application U.S. Ser. No. 10/321,087, filed on Dec. 17, 2002 now U.S. Pat. No. 6,918,452, which is hereby incorporated by reference in its entirety.

BACKGROUND OF THE INVENTION

1. Field of the Invention

This invention relates in general to safety shutoff valves, and particularly to a safety shutoff valve located in a drill string for drilling a well.

2. Background of the Invention

Most oil and gas wells are drilled with a rotary drilling rig. Typically, the drill string has a drill bit on the end and is rotated to cause the drill bit to advance into the earth. A drilling fluid is pumped down the interior passage of the drill pipe, which exits nozzles on the drill bit and flows back up an annular space surrounding the drill pipe along with cuttings.

Normally, the drilling fluid is a liquid called mud, which has a weight selected to provide a hydrostatic pressure greater than the expected earth formation pressures. When tripping the drill string in and out of the hole, the drilling mud in the hole and within the interior of the drill pipe provide sufficient hydrostatic pressure to prevent a blowout. However, heavy drilling mud can damage certain earth formations, reducing their abilities to produce fluids after completion. For example, methane is located in certain fairly deep coal beds. The coal formations may be damaged by encroaching drilling mud.

Drilling with gaseous fluids, such as air, has also been done with oil and gas wells. In one of these techniques, compressed air flows down the interior of the drill pipe, exits the drill bit and flows back up the annulus. A stripper seal surrounds the drill pipe at the surface for sealing the gas pressure in the well. Also, compressed air is used as a drilling fluid for drilling shallow mining blast holes. Mining drilling rigs may employ a dual passage string of drill pipe, with one of the passages being an inner passage and the other an annular passage. A gaseous fluid such as air is pumped down the annular passage and flows back up the inner passage along with cuttings. The dual passage drill pipe can be rotated to rotate the drill bit. Alternately, a downhole motor can be utilized which may also create a reciprocating a hammer motion as well as rotating the drill bit while the drill pipe remains stationary.

The possibility of a blowout due to excessive earth formation pressure is not a factor with shallow drilling of mining blast holes. With deep oil and gas drilling, however, it must be considered both while drilling and while tripping the drill pipe in and out of the hole. Blowout preventers and rams are utilized to seal around the annulus of drill pipe. The use of check valves in the drill string has been proposed in the past. The primary barrier to a blowout, however, continues to be the use of drilling mud with sufficient weight to provide a higher hydrostatic pressure than any expected pressure of the earth formations.

SUMMARY OF THE INVENTION

In this invention, a valve assembly is mounted in a string of drill pipe for selectively closing the passages of the drill pipe. The valve assembly includes an annular valve assembly carried in an annular passage. The annular valve assembly selectively actuates between open and closed positions due to fluid pressure above the annular valve assembly. When the fluid pressure in the annular passage above the annular valve assembly is less than a predetermined amount, the annular valve assembly closes. The annular valve assembly opens when the pressure in the annular passage above annular valve assembly increases above the predetermined amount.

The string of drill pipe also includes an inner passage extending axially through the drill pipe. The valve assembly includes an inner valve assembly carried in the inner passage. The inner valve assembly includes a pair of valve members that rotate upon receiving pressure pulses from the surface. The pressure pulses cause the valve members of the inner valve assembly to rotate, which actuates the inner valve assembly between open and closed positions. Fluid can flow axially upward or downward through the inner valve assembly while in its open position.

The valve assembly of this embodiment is particularly for use with a drill string for drilling with a gaseous drilling fluid. The drill string is preferably of a dual passage type, having an inner conduit and an annular passage surrounding the inner conduit. The valve assembly is particularly useful for drill strings that are coiled tubing. Because coiled tubing cannot be rotated, the inner and outer valve assemblies are actuated by pressure from the surface rather than rotating the drill string.

DETAILED DESCRIPTION OF THE PREFERRED EMBODIMENT

Figure 1A:
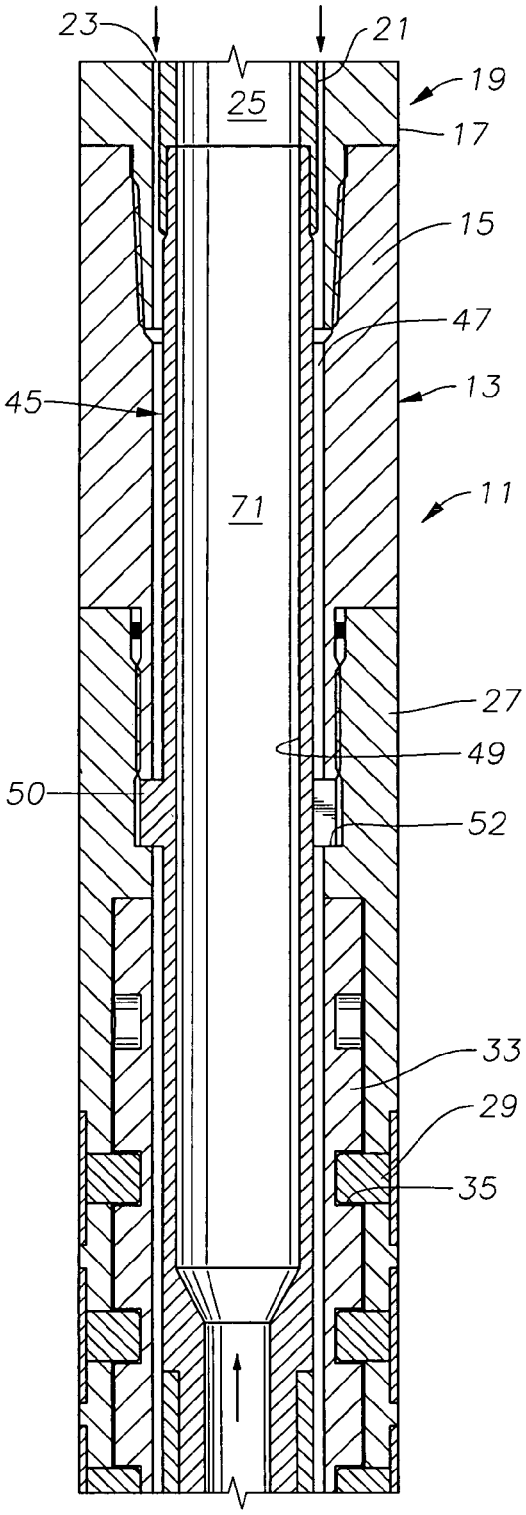
FIGS. 1A and 1B comprise a vertical sectional view of a valve assembly constructed in accordance with this invention and shown in an open position.

Referring to FIG. 1, valve assembly 11 includes an outer tubular member 13, which is made up of several components. An upper adapter 15 forms the upper end of outer member 13. Upper adapter 15 is a tubular member having threads on its upper end for connection to an outer conduit 17 of a dual passage drill string 19. Drill string 19 preferably has an inner conduit 21 extending through it. An annular passage 23 surrounds inner conduit 21, and an inner passage 25 extends through inner conduit 21. Inner conduit 21 and outer conduit 17 may be made of continuous coiled tubing, which is typically of metal. Alternately, outer conduit 17 may be made up of segments of pipe secured together, and inner conduit 21 could be formed of sections of pipe that stab together.

Outer member 13 also has an upper sub 27 that secures to the lower end of adapter 15. Upper sub 27 is a tubular member that has a plurality of pins 29 secured to it. Preferably there are two sets of pins 29, each pin 29 in each set being axially aligned with the others in the same set. The sets of pins 29 are spaced 180° apart and extend radially inward. Upper sub 27 also has a plurality of spaced apart downward facing lugs 31 on its lower end. Lugs 31 contact an upper shoulder of a lower sub 33 of outer member 13 when valve assembly 11 is in the retracted position shown in FIGS. 1A and 1B.

Figure 3:
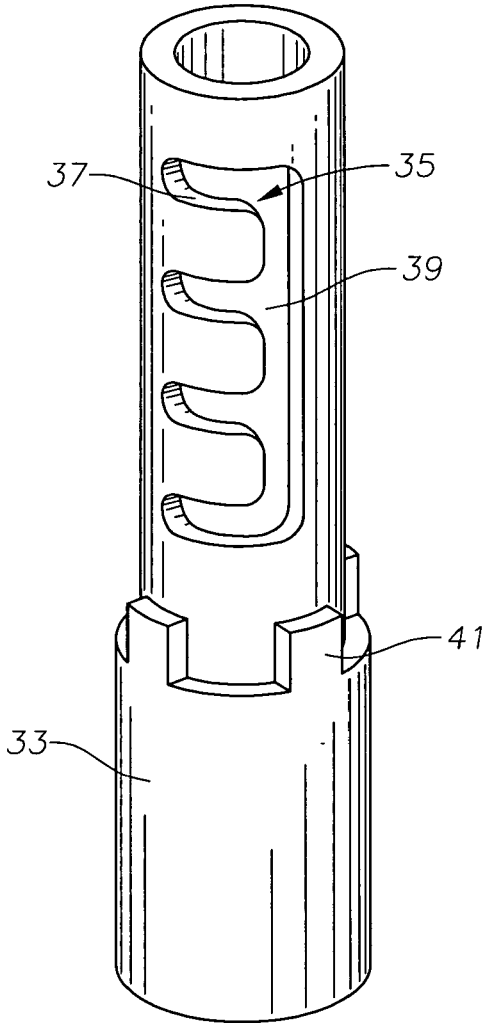
FIG. 3 is a perspective view of part of a lower sub of the outer member of the valve assembly of FIGS. 1A and 1B.
Figure 4:
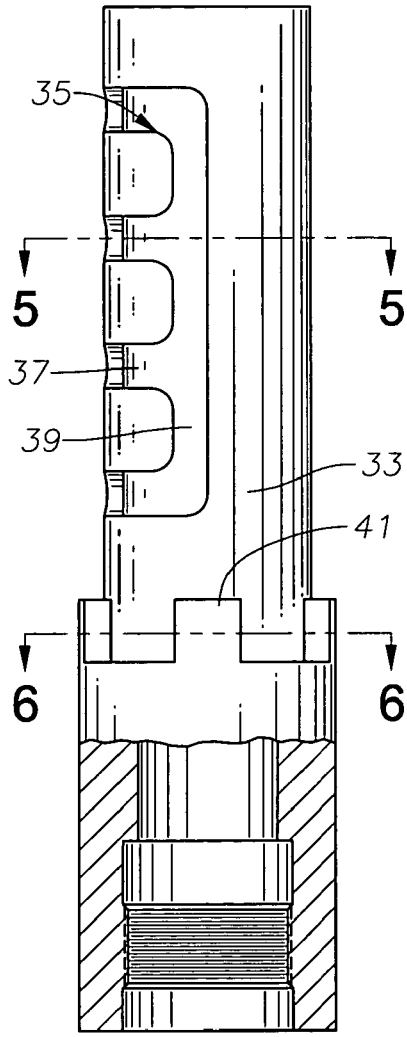
FIG. 4 is a side elevational view, partially sectioned, of the lower sub of FIG. 3.
Figure 5:
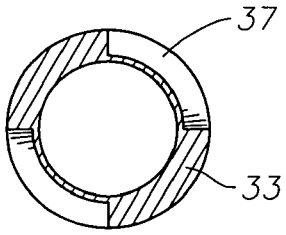
FIG. 5 is a sectional view of the lower sub of FIG. 3, taken along the line 5—5 of FIG. 4.
Figure 6:
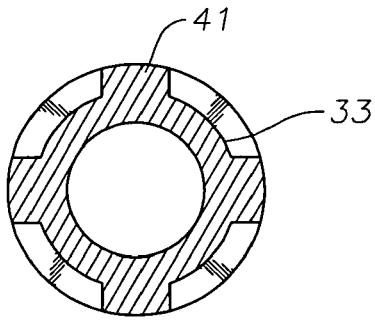
FIG. 6 is a sectional view of the lower sub of FIG. 3, taken along the line of 6—6 of FIG. 4.

Lower sub 33 is a tubular member that has an upper reduced diameter portion that inserts into upper sub 27 and contains a pair of slots 35 for engagement by pins 29. Slots 35 are spaced 180° from each other in this embodiment. As shown in FIG. 3, each slot 35 has a plurality of transverse portions 37 that extend circumferentially about 90° and are parallel to each other. Each transverse portion 37 is perpendicular to the longitudinal axis of lower sub 33 and leads to an axial portion 39 that extends along the length of lower sub 33. Each slot 35 does not extend entirely through the sidewall of lower sub 33, thus does not communicate with the interior of the lower sub 33. Lower sub 33 also has a plurality upward facing lugs 41 that have spaces between them for receiving downward facing lugs 31 (FIG. 1B) of upper sub 27.

Figure 1B:
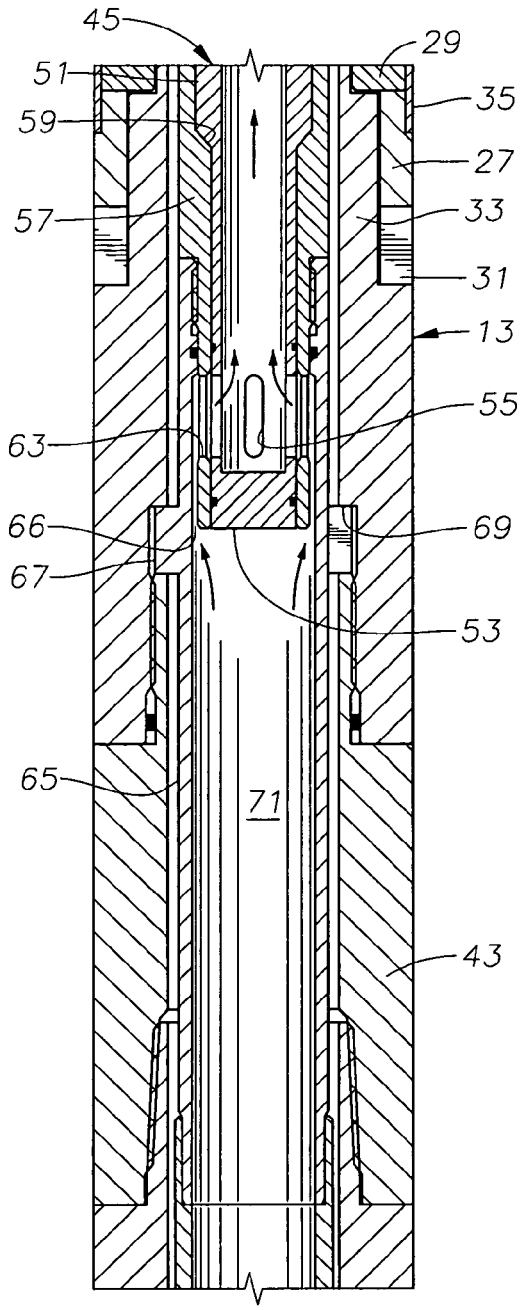

There are more transverse portions 37 of each slot 35 than pins 29. Each set has three pins 29 in this example, while there are four transverse portions 37 (FIG. 3) in each slot 35. Pins 29 are located in the lower three transverse slots 37 while valve assembly 11 is in the open and retracted position of FIGS. 1A and 1B. While in this position, lugs 31 and 41 are intermeshed with each other as shown in FIG. 1B. Each space between each upward extending lug 41 is wider than each downward extending lug 31. This allows upper sub 27 to rotate counterclockwise (looking downward) an increment relative to lower sub 33 while lugs 41 and 31 are intermeshed. While doing so, pins 29 will move from the transverse portions 37 to the axial portion 39. Then, upper sub 27 can move upward relative to lower sub 33 a short distance until the uppermost pin 29 of each set (FIG. 1B) contacts the upper end of axial portion 39. At this point, upper sub 27 can be rotated an increment clockwise relative to lower sub 33 to cause the three pins 29 to enter the upper three transverse portions 37.

The total number of transverse portions 37 should exceed the total number of pins 29, however the number could differ from the four transverse portions 37 and three pins 29 shown in the preferred embodiment. Although lugs 31, 41 allow limited rotation of upper sub 27 relative to lower sub 33, they will transmit torque once in engagement with each other.

Figure 2A:
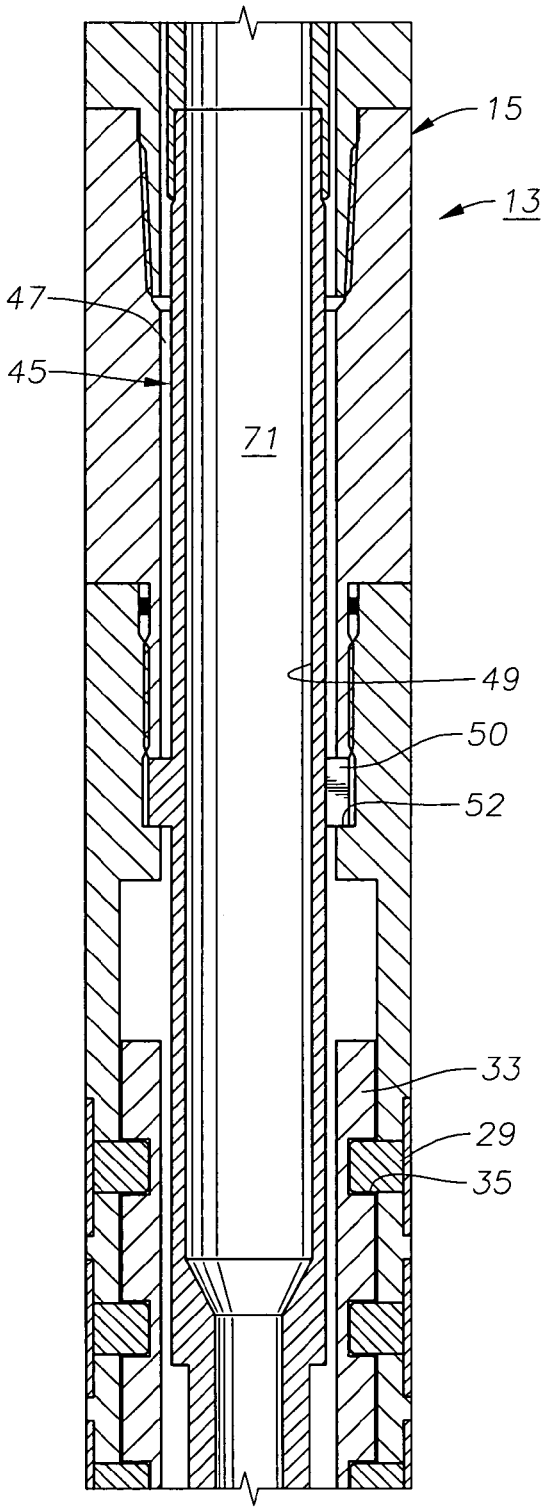
FIGS. 2A and 2B comprise a vertical sectional view of the valve assembly of FIGS. 1A and 1B, but shown in a closed position.
Figure 2B:
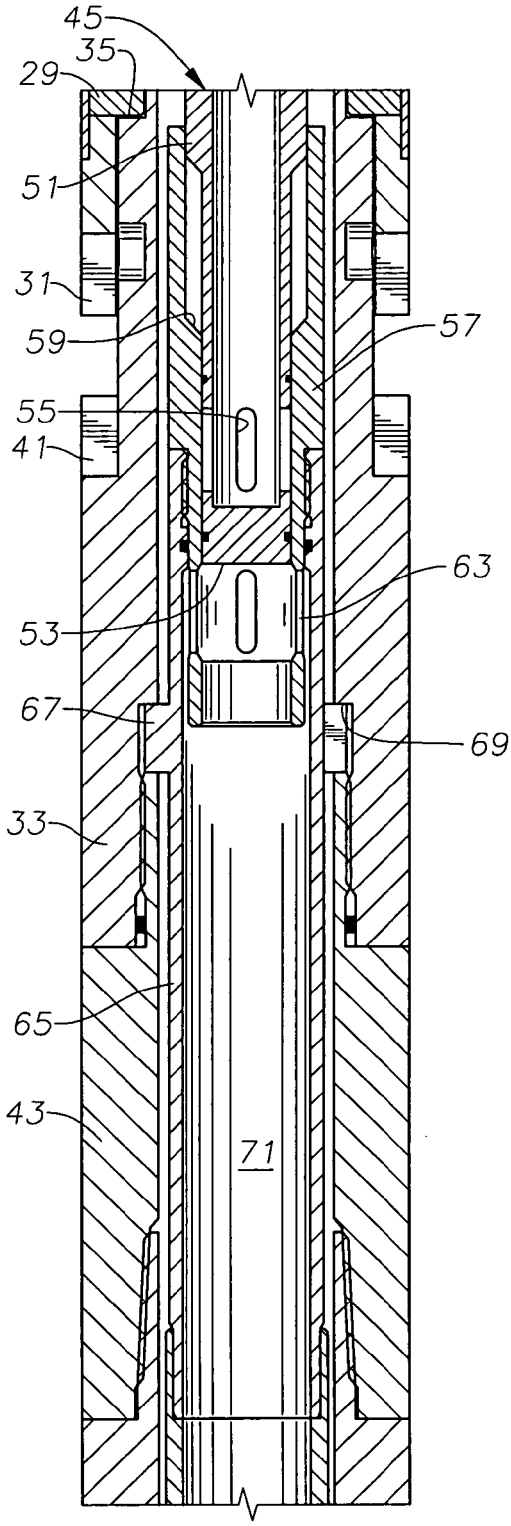

Referring again to FIG. 1B, a lower adapter 43 secures by threads to the lower end of lower sub 33. Lower adapter 43 has the same configuration as upper adapter 15 for connecting to another portion of drill string 19. Preferably lower adapter 43 connects into drill string 19 at a fairly close distance to a drill motor and bit assembly (not shown). Outer member 13 thus is made up of upper adapter 15, upper sub 27, lower sub 33 and lower adapter 43. The upper portion of outer member 13, which is made up of upper sub 27 and upper adapter 15, will telescope upward relative to the lower portion, which is made up of lower sub 33 and lower adapter 43. FIGS. 1A and 1B show the retracted position, while FIGS. 2A and 2B show the extended position.

An inner member 45 extends through outer member 13. Inner member 45 has a number of components, and its outer diameters are all less than the inner diameters of adjacent portions of outer member 13, resulting in an annular passage 47 between inner member 45 and outer member 13. Inner member 45 has a tubular upper portion 49 that joins inner conduit 21 of drill string 19. Inner upper portion 49 has outward extending lugs 50 that are received within a recess of upper sub 27. The recess is defined by an upward facing shoulder 52 of upper sub 27 and the lower end of upper adapter 15. Lugs 50 are spaced apart circumferentially from each other so as to not impede fluid flow through annulus 47. Lugs 50 and shoulder 52 prevent any axial movement of inner upper portion 49 relative to upper sub 27.

Inner upper portion 49 has a valve member 51 formed on its lower end. Valve member 51 comprises a tube that has a closed lower end 53. A plurality of ports 55 are located in the sidewall of valve member 51 directly above closed end 53. Valve member 51 lands within a valve sleeve 57, which has an upward facing conical shoulder 59 that provides a lower limit for the downward travel of valve member 51. Valve sleeve 57 sealingly receives closed end 53. A plurality of bypass ports 63 are located in valve sleeve 57, with each port 63 registering with one of the ports 55 when in the open position of FIGS. 1A and 1B.

An inner member lower tube 65 is secured to valve sleeve 57. The inner diameter of lower tube 65 is greater than the outer diameter of valve sleeve 57 at ports 63 by a selected amount to create an annular clearance 66. While in the position shown in FIG. 1B, fluid may flow upward, as indicated by the arrows, through clearance 66, ports 63, 55, and into the interior of valve member 51. Ports 63 and clearance 66 serve as a bypass to allow flow around closed end 53 of valve member 51 while in the open position.

Lower tube 65 is axially retained with a lower portion of outer member 13, which comprises lower sub 33 and lower adapter 43. This is handled by a plurality of lugs 67 on the exterior of lower tube 65. Lugs 67 locate within a recess that is formed by a downward facing shoulder 69 of lower sub 33 and the upper end of lower adapter 43. Lugs 67 are spaced apart circumferentially to allow fluid flow through annular passage 47.

An inner passage 71 extends through the various components of inner member 45. Inner member 45, like outer member 13, has an upper portion that moves axially relative to a lower portion. The upper portion is made up of inner upper portion 49 and valve member 51. The lower portion of inner member 45 is made up of valve sleeve 57 and lower tube 65.

In operation, valve assembly 11 is connected into drill string 19 at a point near the lower end of the drill string.

Typically, the operator would place valve assembly 11 in a closed position prior to running drill string 19 into the well. This may be done at the drill rig floor by restraining lower adapter 43 against rotation while rotating outer adapter 13 about one-fourth turn in a counterclockwise direction looking downward. This causes pins 29 (FIG. 1B) to move from transverse portions 37 to axial portion 39 (FIG. 3). Either before or after the incremental rotation, the operator suspends valve assembly 11 vertically. This causes upper sub 27 and its pins 29 to move upward relative to lower sub 33 and its slot 35 (FIG. 3). When the upper pins 29 reach the upper ends of axial slots 39, the operator rotates upper adapter 15 one-fourth turn back clockwise relative to lower adapter 43. Pins 39 are now in the upper three transverse slot portions 37 (FIG. 3). Pins 39 and transverse slot portions 37 of slot 35 thus serve as a retainer to maintains valve assembly 11 in the extended position.

As upper sub 27 moves upward relative to lower sub 33, valve member 51 also moves upward relative to valve sleeve 57. Closed lower end 53 moves upward to the position of FIG. 2B above ports 63 in valve sleeve 57. Any upward flow through inner passage 71 will be blocked by closed end 53.

When the drill bit reaches the bottom of the well, the operator will open valve assembly 11 by rotating drill string 19 one-fourth turn counterclockwise. Because of the weight of drill string 19 on valve assembly 11, the lower portion of outer member 13, including lower sub 33, does not rotate, thus causing each set of pins 39 to now enter axial portion 39 of slot 35 (FIG. 3). The operator allows the weight of the drill string above valve assembly 11 to move the upper portion of outer member 13 downward relative to the lower portion of outer member 13 until lugs 31 contact the shoulders between lugs 41. Outer member 13 will then be in compression. At this point, pins 29 (FIG. 1B) will be in alignment with the three lower transverse portions 37 (FIG. 3). The operator rotates drill string 19 one-fourth turn clockwise, causing upper sub 27 to rotate relative to lower sub 33, placing pins 29 at the ends of the transverse portions 37. At the same time the upper portion of outer member 13 moved downward, valve member 51 also moved downward in valve sleeve 57 to the position shown in FIG. 1B. Ports 63 and 55 will now align with each other, placing valve assembly 11 in an open position.

The operator pumps a fluid down annular passage 23, the fluid typically being a gas such as air. The fluid flows down annular passage 47 and is used to drive the drill motor to rotate the drill bit (not shown) while drill string 19 remains stationary. Cuttings and return air flow up inner passage 71, through clearance 66 and ports 63 and 55 into the interior of valve member 51. The fluid continues to flow up inner passage 71 into inner passage 25 of drill string 19. When the operator wishes to close valve assembly 11, he simply reverses the steps mentioned above. Normally, when tripping the drill string 19 out of the well such as to change the drill bit, the operator will close the valve assembly.

The invention has significant advantages. The valve assembly provides a safety shutoff to prevent the flow of gas or other formation fluids up through the drill string, particularly while running the drill string into the well or retrieving the drill string from the well. The valve assembly is particularly useful when drilling into deep coal beds that contain methane gas. The use of air as a drilling medium avoids having to utilize liquid drilling fluids, which tend to encroach into and damage such formations. The valve is easily moved between open and closed positions by manipulating the drill string. The valve can be retained in either the open or closed position.

Figure 7A:
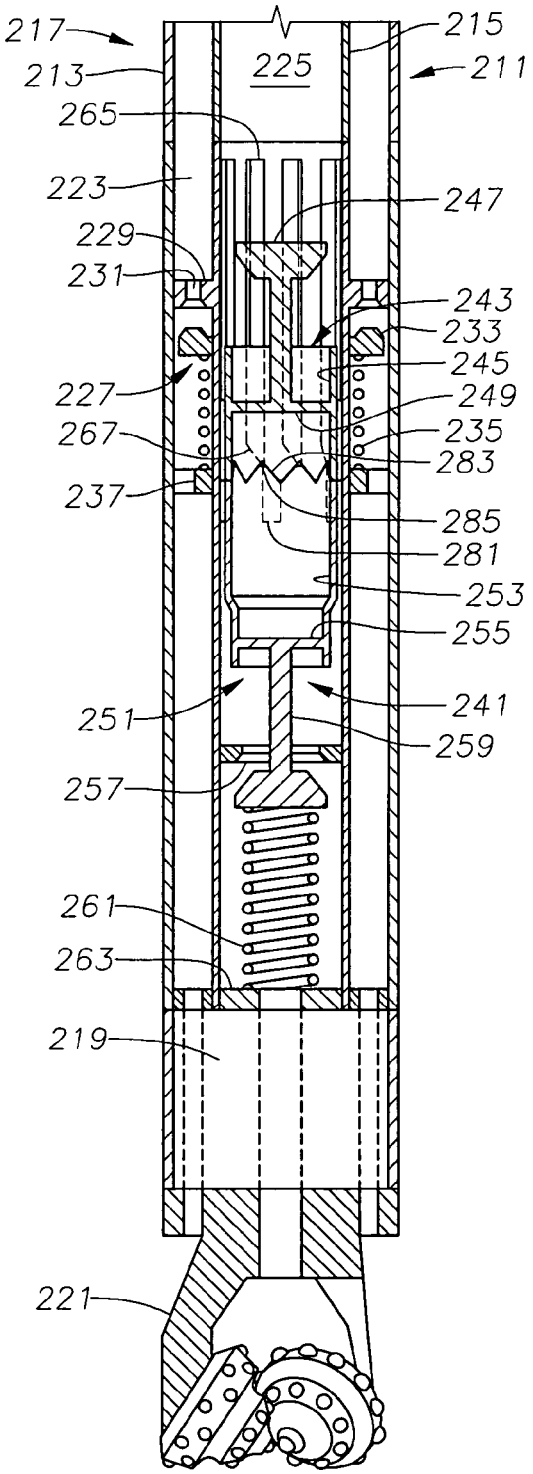
FIG. 7A comprises a vertical sectional view of an alternative valve assembly constructed in accordance with this invention and shown in an open position.
Figure 7B:
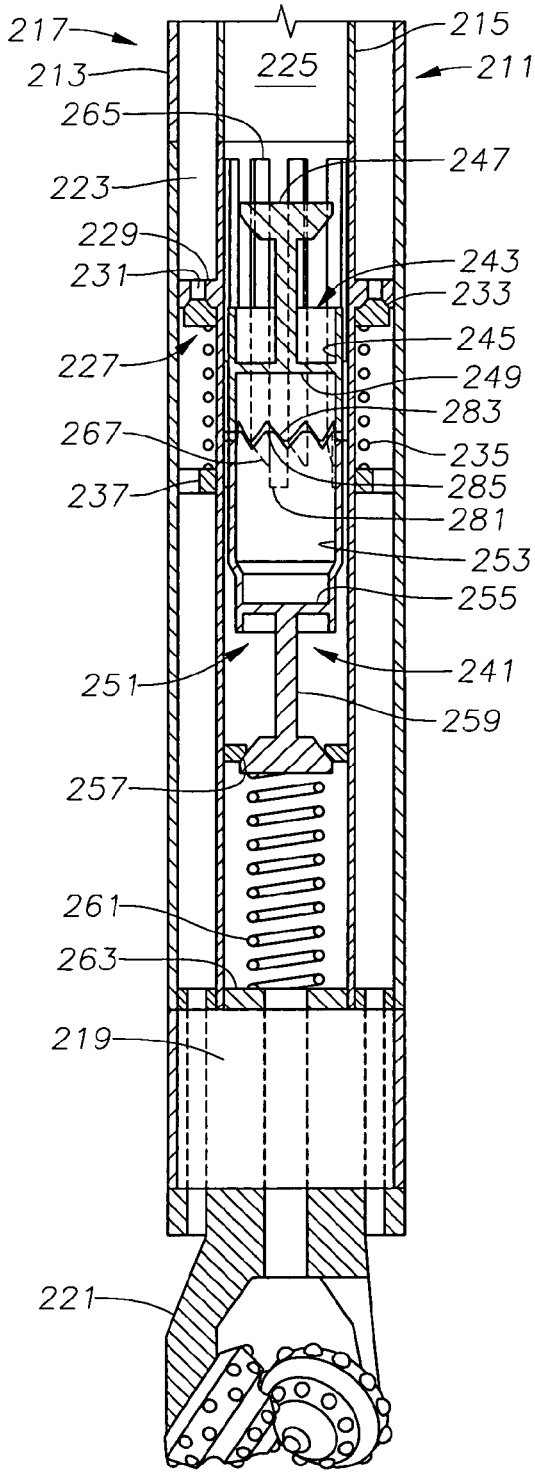
FIG. 7B is a vertical sectional view of the valve assembly of FIG. 7A in a closed position.

Referring to FIGS. 7A and 7B, an alternative embodiment of valve assembly 211 is shown for a dual passage conduit 217. Conduit 217 supporting valve assembly 211 is preferably a string of coiled tubing. Coiled tubing 217 is unable to be rotated, compressed, and extended during drilling operations like the assembly shown in FIGS. 1A-6, therefore a manner of regulating fluid flow within the conduit from the drill bit is desired.

Valve assembly 211 preferably includes an outer tubular member 213 and an inner tubular member 215. Valve assembly 211 is located within a lower portion of coiled tubing 217 extending from the surface. In the preferred embodiment, outer tubular member 213 is a portion of coiled tubing 217, and inner tubular member 215 within outer member 213 is also a portion of coiled tubing 217. Alternatively, inner and outer tubular members 213, 215 of valve assembly 211 can be fixedly attached to a dual passage string of coiled tubing 217. Valve assembly 211 supports a downhole motor 219 and a drill bit 221 below valve assembly 211. Downhole motor 219 is preferably a centrifugal motor that is powered, in a manner known by those in the art, by fluid transmitted through coiled tubing 217. Motor 219 drives drill bit 221 during drilling operations.

The inner surface of outer tubular member 213 and the outer surface of inner tubular member 215 define an outer annulus 223 for fluid flow through an outer passage of coiled tubing 217 to drill bit 221. The interior surface of inner tubular member 215 defines an inner passage 225 in fluid communication with the inner passage of coiled tubing 217 and drill bit 221. Drill bit 221 is in fluid communication with inner and outer passages 223, 225 through motor 219.

Valve assembly 211 preferably includes an annular valve assembly 227 located in outer annulus 223 between outer and inner tubular members 213, 215. Preferably, a valve seat 229 extends radially outward from the outer surface of inner tubular member 215 and sealingly engages the interior surface of outer tubular member 213. A valve passage 231 extends axially through valve seat 229. Preferably, there are a plurality of valve passages 231 extending axially through valve seat 229 around the circumference of inner tubular member 215. Annular valve passages 231 thereby provides a plurality of passages 231 for fluid to flow through outer annulus 223 between portions of outer annulus 223 above and below valve seat 229.

A valve piston 233 regulates flow through valve passages 231. Valve piston 233 preferably has a circular cross section allowing it to slidingly engage the outer surface of inner tubular member 215. Valve piston 233 selectively actuates between open and closed positions within valve assembly 227 to regulate flow through valve passages 231 by engaging and disengaging valve seat 229. A valve spring 235 located axially below valve piston 233 biases valve piston 233 toward valve seat 229 and valve passages 231. A spring retainer 237, located below valve spring 235, provides a physical barrier for spring 235 to engage while biasing valve piston 233 toward valve seat 229.

A predetermined fluid pressure within outer annulus 223 above valve passage 231 to compress valve spring 235 and disengages valve piston 233 from valve seat 229, thereby opening annular valve assembly 227. Preferably, when fluid pressure in the portion of outer annulus 223 is less than the predetermined amount above valve seat 229, valve spring 235 expands against valve piston 233 until valve seat 229 and valve piston 233 are in substantial contact with each other. Therefore, annular valve assembly 227 actuates between open and closed positions through pressure supplied from the surface through outer annulus 223. When pressure is not supplied through outer annulus 223 toward valve assembly 211, annular valve assembly 227 is in its closed position as shown in FIG. 7B. When pressure is supplied through outer annulus 223 toward valve assembly 211 annular valve assembly 227 is in its open position as shown in FIG. 8A.

Valve assembly 211 also includes an inner valve assembly 241 located within in inner tubular member 215. Inner valve assembly 241 preferably includes an upper valve member 243 having an upper valve member casing 245, which slides within the interior of inner tubular member 215. An upper valve member piston 247 is located along a central axis within upper valve member casing 245. An upper valve member spider 249 connects a lower portion of upper valve member piston 247 to an interior surface of upper valve member casing 245. Upper valve member piston engages upper valve member casing 245 through upper valve member spider 247 to actuate upper valve member 243 up and down within inner tubular member 215. Preferably, upper valve member piston 247 is selectively actuated through pressure pulses acting on an enlarged upper surface of upper valve member piston 247 from the surface through inner tubular member 215.

A lower valve member 251, located below upper valve member 243 preferably includes a lower valve member casing 253 which slides within inner tubular member 215. An upper surface of lower valve member casing 253 engages a lower surface of upper valve member casing 245 as upper valve member 243 actuates up and down due to the pressure pulses experienced by upper valve member piston 247. Lower valve member 251 also preferably includes a lower valve member spider 255 extending between interior surfaces of lower valve member casing 253. Lower valve member casing 253 preferably includes an inner valve piston 259 that is connected to lower valve member spider 255 and extends axially downward through inner tubular member 215 and lower valve member 251.

An inner valve seat 257 is formed within inner tubular member 215 below lower valve member casing 253 and above a portion of inner valve piston 259. Preferably, inner valve seat 257 is formed with a circular cross section having a smaller radius than lower valve member casing 253. Inner valve seat 257 is fixedly attached to inner tubular member 215, thereby remaining stationary relative to lower valve member 251 as inner valve piston 259 moves axially upward and downward inside inner tubular member 215. An inner valve spring 261, located below inner valve piston 259, biases inner valve piston 259 axially upward toward upper valve member 243 and inner valve seat 257. Preferably, inner valve piston 259 has a portion which sealingly engages inner valve seat 257 when inner valve piston 259 is biased upward by inner valve spring 261. When inner valve piston 259 engages inner valve seat 257 inner valve assembly 241 is in its open position. When inner valve spring 261 is contracted so that inner valve piston 259 is below inner valve seat 257, inner valve assembly 241 is in its open position as shown in FIG. 7A. An inner valve retainer 263 is preferably located below inner valve spring 261 for providing a surface against which inner valve spring 261 engages to thereby bias inner valve piston 259 axially upward.

Inner valve spring 261 expands and contracts upon engagement by inner valve piston 259. Upward and downward movements of lower valve member casing 253 move inner valve piston 259 axially upward and downward relative to inner tubular member 215. Lower valve member casing moves axially upward and downward relative to inner tubular member 215 due to axial upward and downward movement of upper valve member 243, which is actuated by pressure pulses on upper valve member piston 247.

Figure 8:
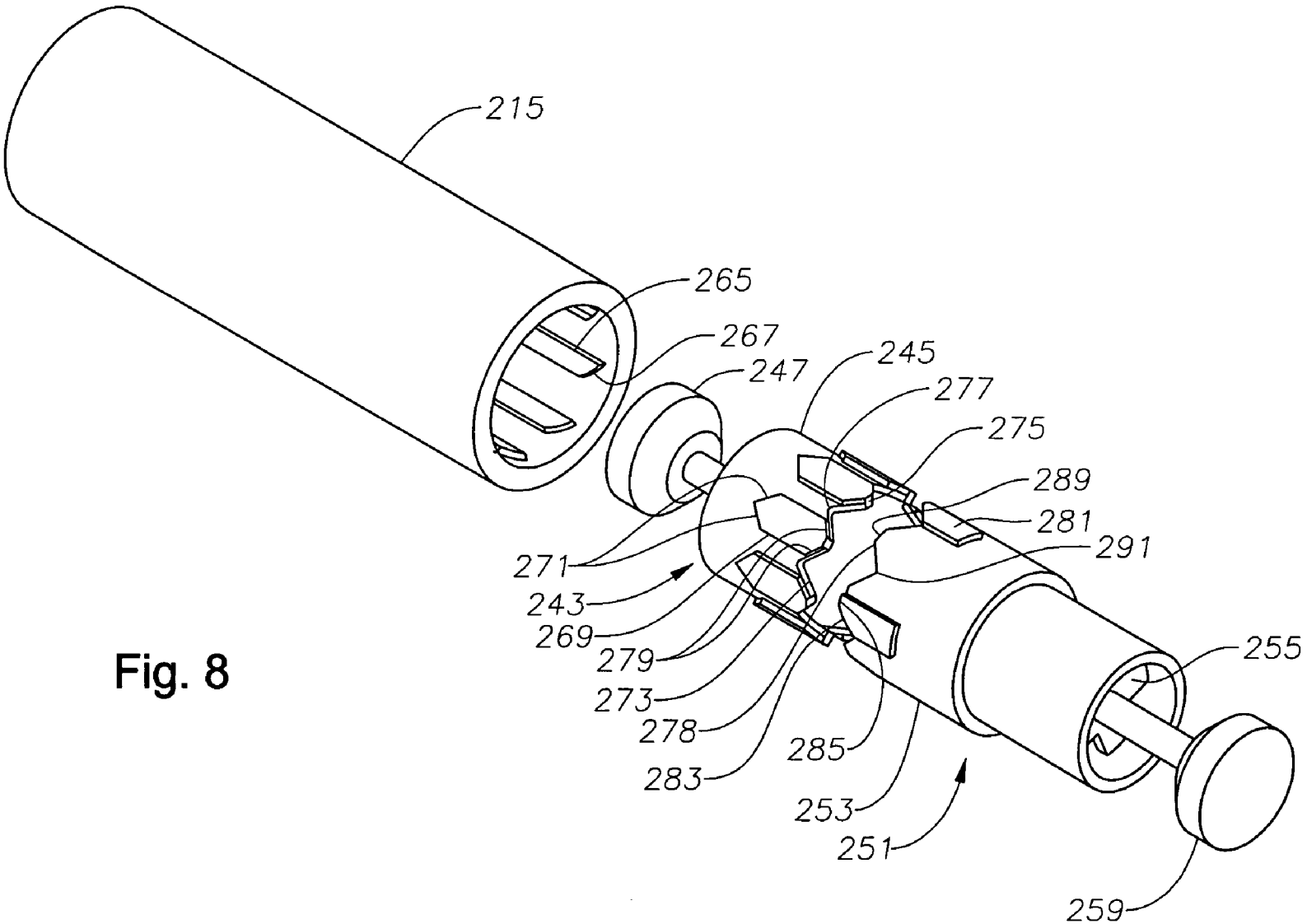
FIG. 8 is an exploded view of a portion of the valve assembly shown in FIG. 7A.

Referring to FIGS. 7A, 7B and 8, a plurality of guide vanes 265 are preferably formed on the interior surface of inner tubular member 215 within inner valve assembly 241. Preferably, guide vanes 265 are formed an axial depth to engage upper valve member 243 and the upper surface of lower valve member 251 (as shown with dotted lines in FIGS. 7A and 7B. The lower end of each guide vane 265 preferably includes a sloping face 267. A plurality of upper keys 269 are formed on the outer surface of upper valve member casing 245. Upper keys 269 preferably slide within guide vanes 265 as upper valve member 243 moves axially upward and downward relative to inner tubular member 215. Upper keys 269 preferably include sloped faces 271 located toward the axially upward portion of upper keys 269. Sloped faces 271 preferably engage sloped downward faces 267 of guide vanes 265 as upper valve member 243 slides axially downward relative to guide vanes 265 and inner tubular member 215.

The combination of upper sloped faces 271 of upper keys 269 and downward sloping faces 267 of guide vanes 265 causes upper valve member 243 to rotate a predetermined incremental amount. Preferably, there are as many upper keys 269 as there are slots between guide vanes 265 so that an upper key 269 is always located within a guide vane 265 as upper valve member 243 slides axially upward and downward within guide vanes 265. After being actuated to an axial depth, such that the engagement as sloped downward faces 267 of guide vanes 265 and upper sloped faces 271 of upper keys 269 causes upper valve member 243 to rotate incrementally, each upper key 269 rotates into position for sliding engagement with an adjacent guide vane 265.

Preferably, a plurality of sloped surfaces 273 of upper valve member casing 245 are formed at the axially lower end of upper valve member casing 245. Sloped surfaces 273 preferably include downward facing crests 275 and upward facing valleys 277. The combination of downward facing crests 275 and upward facing valleys 277 form a grooved profile for engaging lower valve member casing 253 of lower valve member 251. Upper keys 269 preferably include lower sloped faces 279. The slopes of lower sloped faces 279 preferably correspond to sloped surfaces 273 of upper valve member casing 245. Accordingly, downward crest 275 and upper valleys 277 are also formed by lower sloped faces 279 of upper keys 269.

Preferably, a plurality of lower keys 281 are formed around the outer surface of lower valve member casing 253. A sloped face 283 is formed toward the axially upper portion of lower keys 281 for engaging sloped faces 271 of upper keys 269. A flat upper face 285 is also formed at an axially upward portion of lower keys 281 for engaging upper keys 269 at downward facing crest 275. Preferably, lower valve member casing 253 has sloped surfaces 287 formed on its upper end for engaging sloped surfaces 273 of upper valve member 245. Sloped surfaces 287 of lower valve member 251 preferably include upward protruding crests 289 and downward facing valleys 291. Preferably, upward facing crests 289 include a flat portion rather than protruding to a point. Sloped face 283 of lower keys 281 is formed along one of sloped surfaces 287 toward upward protruding crest 289. Preferably, flat portion 285 of lower key 281 is formed to correspond with the flat upper portion of upward protruding crest 289. Preferably, lower keys 281 are intermittently spaced around the circumference of lower valve member casing 253 so that the number of lower keys 281 is substantially half the number of upper keys 269 and substantially half the number of guide vanes 265.

Sloped surface 283 engages sloped surface 279 of upper keys so that lower valve member 251 rotates an incremental step relative to upper valve member 243. At one incremental step of lower valve member 251 relative to upper valve member 243, downward facing crests 275 extend into downward facing valleys 291 while upward facing crest 289 extend into upper facing valleys 277. While in this position, flat portion 285 of lower keys 281 is at a position between upper keys 269. Upon sloped surfaces 273 and 287 engaging each other as described. Flat portion 285 of lower keys 281 engage guide vanes 265 as lower and upper valve members 243, 251 slide axially upward through inner tubular member 215 when flat portion 285 is located between upper keys 269. Flat portion 285 of lower keys 281 prevent lower valve member 251 from sliding axially upward beyond sloped downward faces 267 of guide vanes 265.

Upon receiving another pressure pulse, upper valve member 243 slides axially downward relative to guide vanes 265 within inner tubular member 215. Sloped surfaces 273 of upper valve member 243 engage sloped surfaces 287 of lower valve member 251 which is being held in place against sloped downward faces 267 of guide vanes 265 by inner valve spring 261. As upper valve member 243 continues to engage lower valve member 251, upper valve member 243 and lower valve member 251 slide axially downward relative to guide vanes 265 so that flat portion 285 of lower keys 281 are no longer in engagement with sloped downward faces 267 of guide vanes 265. While lower valve member 251 is being pushed axially downward by upper valve member 243, lower sloped faces 279 of upper keys 269 engage sloped faces 283 of lower keys 281. The engagement of sloped surfaces 283 of lower keys 281 and sloped surface 271 of upper keys 269 causes lower valve member 251 to rotate incrementally relative to upper valve member 243. Upon incremental rotation, flat portion 285 of lower keys 281 is engaging the downward facing crest portion of upper keys 269 which correspond to downward crests 275 of upper valve member 243.

As upper valve member 243 and lower valve member 251 continue to move axially downward relative to guide vanes 265, upper sloped faces 271 of upper keys 269 engage downward sloping faces 267 of guide vanes 265, which rotates both upper valve member 243 and lower valve member 251 in incremental step relative to guide vanes 265 and inner tubular member 215. Upon rotating this incremental step, upper keys 269 and lower keys 281 are aligned for sliding axially upward within guide vanes 265 (not shown). After a pressure pulse through inner passage 275 ceases, upper valve member 243 and lower valve member 251 slide axially upward through inner tubular member 215 within guide vanes 265. With lower keys aligned such that flat portion 285 is engaging downward facing crest 275 of upper keys and upper valve member 243, lower keys 281 are allowed to slide within guide vanes 265 which allows inner valve spring 261 to push lower valve member 251 axially upward so that inner valve piston 259 engages inner valve seat 257 as shown in FIG. 7B. Sloped face 283 of lower keys 281 slidingly engages the point of downward sloping faces 267 of guide vanes 269 to rotate lower valve member casing 253 relative to upper inner valve member casing 245 another incremental step. When rotated, as shown in FIG. 7B, flat portion 285 slides partially up lower sloped faces 279 of upper keys 269. A gap is formed between sloped faces 279, 283 in the closed position shown in FIG. 7B.

Upon receiving another pressure pulse through inner passage 225, inner valve member 243 engages lower valve member 251 along guide vanes 265. Lower valve member 251 rotates axially relative to upper valve member due to sloped surfaces 273 and 287 after sliding axially downward below guide vanes 265. After upper valve member 243 makes another incremental rotation relative to guide vanes 265 due to slope downward face 267 and upper sloped face 271 on upper keys 269 and guide vanes 265, flat portion 285 of lower keys 281 are positioned within upper valleys 277 between upper keys 269. In this position, there is no gap between the grooved profiles of upper and lower casings 245, 253. As lower valve member 251 and inner valve member 243 begin sliding axially upward relative to guide vanes 265 and inner tubular member 215, flat portion 285 of lower keys 281 engages guide vanes 265 and thereby prevents lower valve member 251 from sliding axially upward within guide vanes 265.

Figure 9:
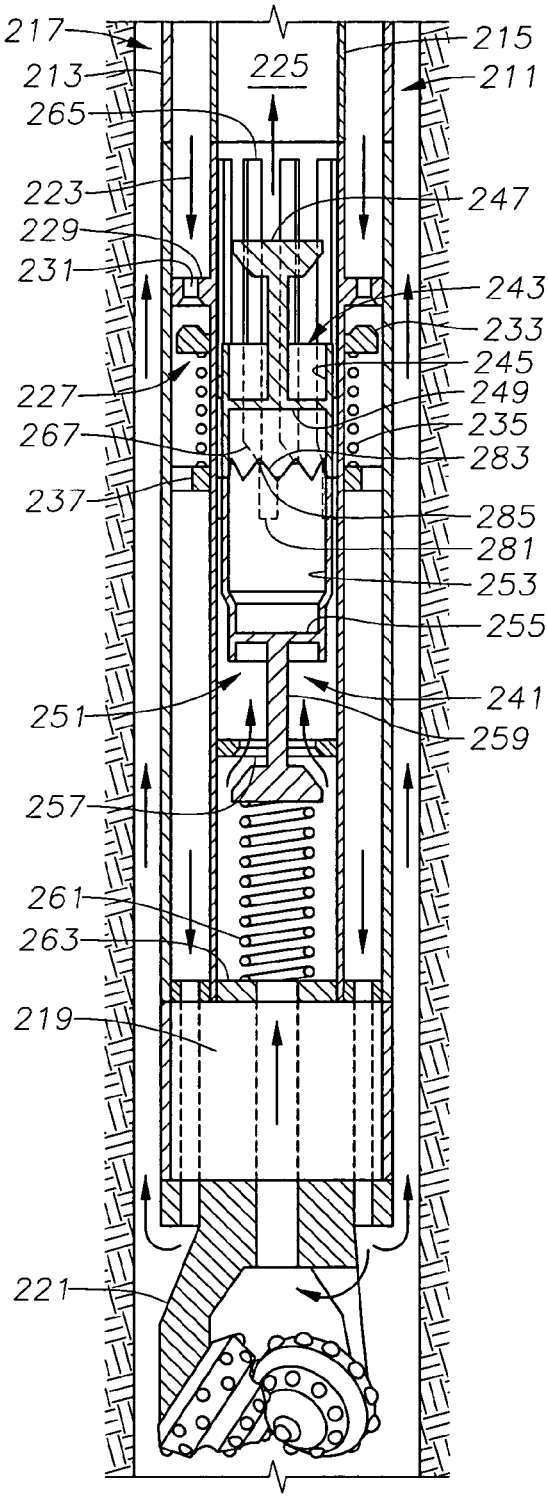
FIG. 9 is a vertical sectional view of the valve assembly of FIG. 7A showing the flow of circulation when the valve assembly has its inner and annular valves open.

In operation, an operator has a variety of valve configurations for air flow within valve assembly 211. FIGS. 9 through 12 show various configurations available to operators using valve assembly 211 during drilling operations. Referring to FIG. 9, inner valve assembly 241 is shown in its open position as shown in FIG. 7A. In the configuration shown in FIG. 9, the operator supplies air through outer annulus 223. Providing air through outer annulus 223 opens annular valve assembly 227 thereby allowing air flow to power motor 219 and to drill bit 221. Air being discharged from drill bit 221 flows into inner passage of drill bit 221 or into an annular region surrounding drill bit 221 and valve assembly 211 within the well formation. Air flowing into the inner opening of drill bit 221 flows through the central opening of motor 219 and into inner valve assembly 241. With the inner valve assembly in the open position as shown in FIG. 9 air and cuttings from drill bit 221 flow through inner passage 225 to the surface.

Figure 10:
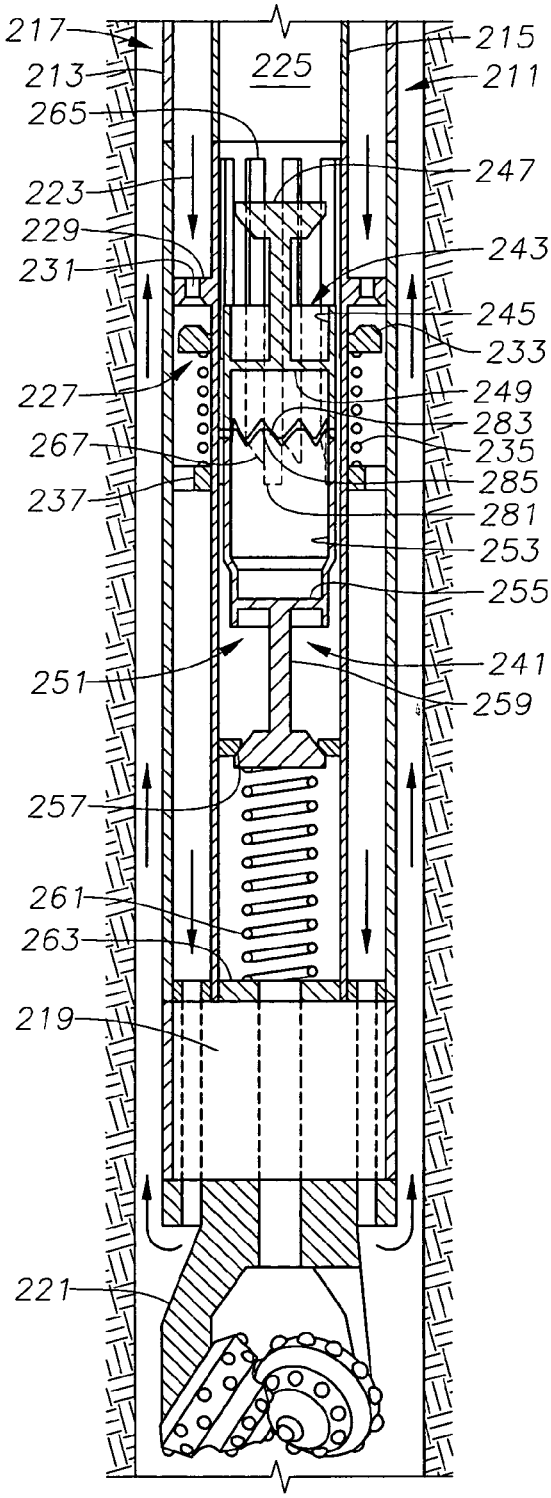
FIG. 10 is a vertical sectional view of the valve assembly of FIG. 7A showing the flow of circulation when the annular valves are open and the inner valve is closed.

Referring to FIG. 10, inner valve assembly 241 is actuated towards closed position with a pressure pulse as described above. The operator supplies air through outer annulus 223 which in turn opens annular valve assembly 227. Air passing through annular valve assembly 227 continues through annular passage 223 to power motor 219 which drives drill bit 221. Discharged air and drilling cuttings cannot flow into inner passage 225 because inner valve assembly is in its closed position. Therefore, discharged air and drill cuttings from drill bit 221 flow up the annulus formed around the exterior of valve assembly 211 within the well formation.

Figure 11:
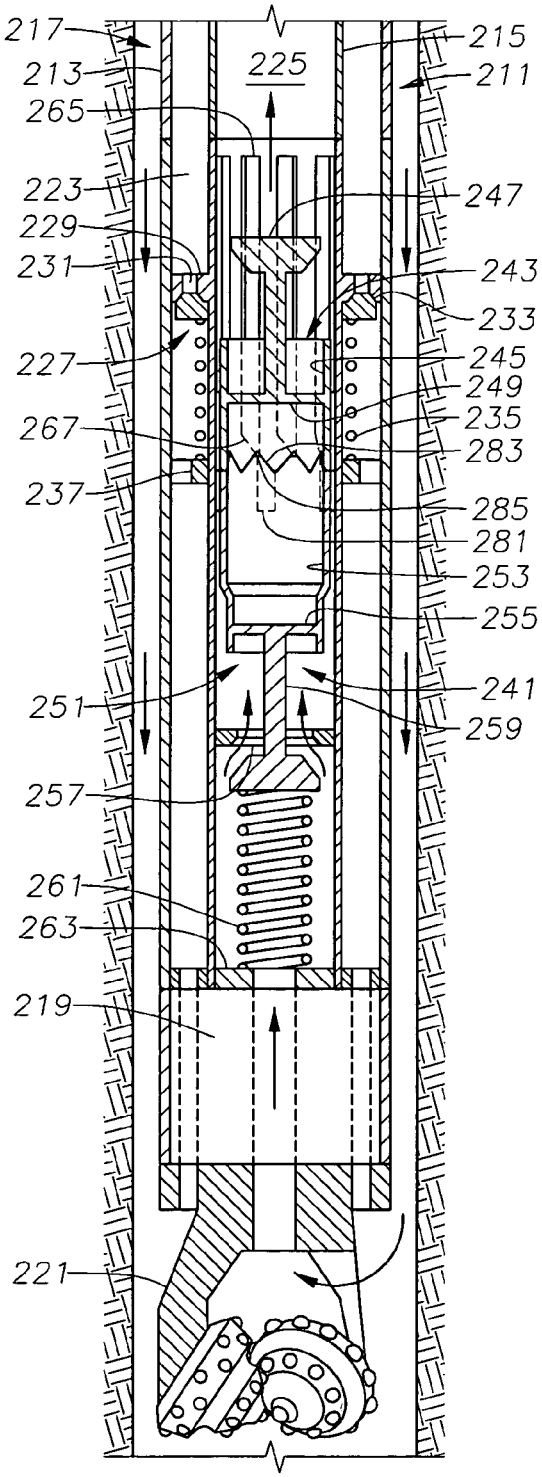
FIG. 11 is a vertical sectional view of the valve assembly of FIG. 7A showing a flow of circulation when the annular valves are closed and the inner valve is open.
Figure 12:
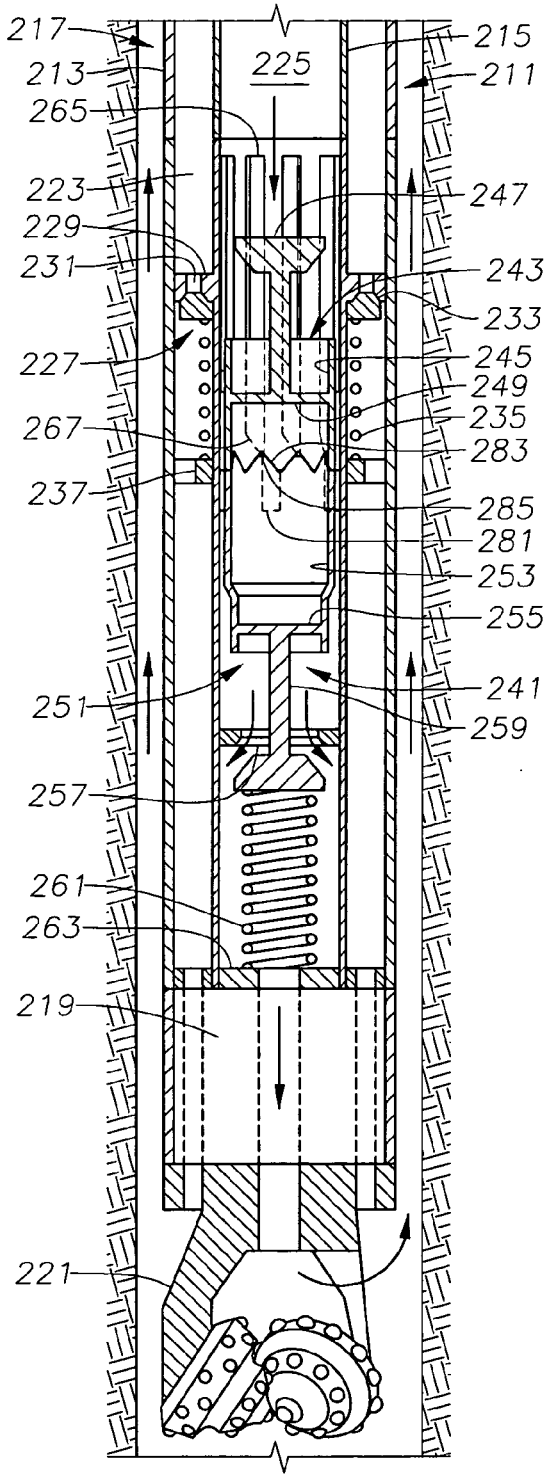
FIG. 12 is a vertical sectional view of the valve assembly showing another flow of circulation when the annular valves are closed and the inner valve is open.

Referring to FIG. 11, an operator has an alternative option of not supplying air through outer annulus 223. By not supplying air through outer annulus 223, annular valve assembly 227 closes therefore blocking flow of air and drill cuttings up outer annulus 223 towards the surface. Inner valve assembly 241 is shown in its open position in FIG. 11. In operation, the operator pumps air down an annular passage formed outside of valve assembly 211 and outer tubular member 213 through the well formation. Upon reaching drill bit 221, air and cuttings flow into inner passage 225 and through open inner valve assembly 241 back up to the surface. Alternatively, as shown in FIG. 12, the operator can pump air through inner passage 225 through valve assembly 211 to motor 219 and drill bit 221. Like the configuration shown in FIG. 11, annular valve assembly 227 in FIG. 12 is also in its closed position as operator is not supplying air through outer annulus 223 through annular valve assembly 227. Air flowing through inner passage 225 inner valve 211 and out of inner portion of drill bit 221 flows into the annular chambers of the well formation surrounding valve assembly 211 and coiled tubing 217. The discharged air and cuttings from drill bit 221 flow up an annular portion surrounding coiled tubing 217 within the well formation being drilled back up to the surface.

In each of the configurations shown in FIGS. 9–12, in the event the operator needs to shut off all fluid flow within coiled tubing 217 from drill bit 221, the operator can close annular valve assembly 227 by discontinuing any downward air flow through annular passage 225 with a pulse of air pressure against upper valve member piston 247 to cause lower valve member 251 to rotate so that inner valve piston 259 engages inner valve seat 257 upon being pushed axially upward with inner valve spring 261 after the pressure pulse is completed. Valve assembly 211 provides a way for the operator to close outer annulus 223 and inner passage 225 during drilling operations with coiled tubing 217, which cannot be actuated like valve assembly 11 shown in FIGS. 1A through 6. Valve assembly 211 provides an operator deciding to use dual passage coiled tubing with a control system comparable to valve assembly 11 shown in FIGS. 1A through 6 which requires rotating and compressing and retracting the dual passage drill string.

Coiled tubing 217 cannot rotate like the drill string shown in FIGS. 1A-6. Valve assembly 211 provides a way of opening and closing valves in inner and annular valve passages 223, 225. Valve assembly 211 allows an operator to regulate flow through inner and annular passages 223, 225 of coiled tubing 217 for circulation of drill cuttings and drilling fluid during drilling operations. Coiled tubing 217 can be preferable because it is easier to remove for repairs than some other drill strings.

While the invention has been shown in only some of its forms, it should be apparent to those skilled in the art that it is not so limited but is susceptible to various changes without departing from the scope of the invention. For example, although the drill strings shown have dual passages within it, the valve assembly could also operate with a single passage drill string, with the exterior of the valve assembly serving as an annulus passage for return flow.

That claimed is:

1. An apparatus for opening and closing a passage of a drill string, comprising:

a concentric string of conduit for suspending a drill bit and a motor, the concentric string of conduit defining an inner passage and an annular passage within the concentric string of conduit, the inner and annular passages being independently in fluid communication with the drill bit;

an inner valve assembly carried in the inner passage that is selectively actuated between open and closed positions for regulating fluid flow through the inner passage; and an annular valve assembly carried in the annular passage that is selectively actuated between open and closed positions for regulating fluid flow through the annular passage.

2. The apparatus according to claim 1, wherein the annular valve assembly further comprises:

an annular valve passage; and an annular valve piston that selectively engages the annular valve passage for opening and closing the annular valve assembly.

3. The apparatus according to claim 2, wherein the annular valve assembly further comprises an annular valve spring for biasing the annular valve piston into engagement with the annular valve passage.

4. The apparatus according to claim 1, wherein the portion of the annular passage above the annular valve assembly is in fluid communication with the inner passage when the annular valve assembly is open.

5. The apparatus according to claim 1, wherein the annular valve assembly blocks fluid communication between the inner passage and the portion of the annular passage above the annular valve assembly when the annular valve assembly is closed.

6. The apparatus according to claim 1, wherein the annular valve assembly is a one-way valve for allowing fluid flow axially downward through the annular passage.

7. The apparatus according to claim 1, wherein the inner valve assembly is a two-way valve for allowing fluid flow through the inner passage while the inner valve assembly is open.

8. The apparatus according to claim 1, wherein the inner valve assembly further comprises an upward facing piston that receives pressure pulses for actuating the inner valve between open and closed positions.

9. The apparatus according to claim 1, wherein the inner valve assembly further comprises an upper valve casing and a lower valve casing that incrementally rotate and slide axially downward during each pressure pulse.

10. The apparatus according to claim 1, wherein the inner and annular passages are independently in fluid communication with a surface end of the drill string located at the surface.

11. The apparatus according to claim 1, wherein the inner passage comprises an axial inner passage extending axially through the concentric string of conduit, and the inner valve regulates fluid flow through the axial inner passage.

12. An apparatus for opening and closing a passage of a drill string, comprising:

a concentric string of conduit for suspending a drill bit and a motor, the concentric string of conduit defining an axial inner passage extending axially through the concentric string of conduit and an annular passage within the concentric string of conduit, the inner and annular passages being independently in fluid communication with the drill bit;

an annular valve assembly carried in the annular passage that is selectively actuated between open and closed positions for regulating fluid flow through the annular passage; and an inner valve assembly carried in the axial inner passage that is selectively actuated between open and closed positions for regulating fluid flow through the axial inner passage.

13. The apparatus according to claim 12, wherein the annular valve assembly further comprises an annular valve piston for selectively opening and closing the annular valve assembly.

14. The apparatus according to claim 13, wherein the annular valve assembly further comprises an annular valve spring that engages and biases the annular valve piston to a closed position of the annular valve assembly, the annular valve spring is contracted when the annular valve assembly is in its open position.

15. The apparatus according to claim 12, wherein the inner valve assembly blocks fluid communication between the portion of the axial inner passage above the inner valve assembly and the portion of the annular passage above the annular valve assembly when the inner valve assembly is closed.

16. The apparatus according to claim 12, wherein the inner valve assembly further comprises an upward facing piston that receives pressure pulses for actuating the inner valve between open and closed positions; and an upper valve casing and a lower valve casing that incrementally rotate and slide axially downward during each pressure pulse.

17. The apparatus according to claim 16, wherein the inner valve assembly further comprises a plurality of vanes formed on the interior surface of the axial inner passage, the lower ends of the vanes engage an upper portion of the lower valve casing at preselected increments for holding the inner valve in an open position.

18. The apparatus according to claim 17, further comprising:

an inner valve piston connected to the lower valve casing that sealingly closes the inner valve when in an upward position, the lower valve casing holding the inner valve piston in a downward position while the vanes engage upper portion of the lower valve casing.

19. The apparatus according to claim 18, wherein the upper portion of the lower valve casing slides axially upward beyond the lower ends of the vanes at preselected increments for closing the inner valve assembly.

20. The apparatus according to claim 12, wherein the inner and annular passages are independently in fluid communication with a surface end of the drill string located at the surface.

21. A method for opening and closing a passage of a drill string suspending a drill bit and a motor, comprising:

providing a concentric string of conduit having an inner passage and an annular passage within the concentric string of conduit that are independently in fluid communication with the drill bit, an inner valve assembly carried in the inner passage, and an annular valve carried in the annular passage;

opening the inner valve assembly with a pressure pulse from the surface that causes the inner valve assembly to rotate into an open position;

opening the annular valve by supplying fluid pressure in the annular passage above the annular valve; and closing the annular valve by discontinuing the supply of fluid pressure in the annular passage above the annular valve.

22. The method according to claim 21, further comprising:

closing the inner valve assembly with another pressure pulse from the surface that causes the inner valve assembly to rotate into a closed position.

* * * * *

UNITED STATES PATENT AND TRADEMARK OFFICE

CERTIFICATE OF CORRECTION

PATENT NO. : 7,090,033 B2
APPLICATION NO. : 10/677917
DATED : August 15, 2006
INVENTOR(S) : Kwong-Onn C. Chan et al.

It is certified that error appears in the above-identified patent and that said Letters Patent is hereby corrected as shown below:

Column 5, lines 56-67, delete the paragraph beginning: "The invention has significant advantages. The valve assembly provides a safety shutoff to prevent the flow of gas or other formation fluids up through the drill string, particularly while running the drill string into the well or retrieving the drill string from the well. The valve assembly is particularly useful when drilling into deep coal beds that contain methane gas. The use of air as a drilling medium avoids having to utilize liquid drilling fluids, which tend to encroach into and damage such formations. The valve is easily moved between open and closed positions by manipulating the drill string. The valve can be retained in either the open or closed position."

Column 6, line 58, delete "to compress" and insert --compresses--
Column 9, line 11, delete ". Upon" and insert --and--;
Column 9, line 11 insert --are-- after "287"

Column 11, line 32, add the following paragraph: -- The invention has significant advantages. The valve assembly provides a safety shutoff to prevent the flow of gas or other formation fluids up through the drill string, particularly while running the drill string into the well or retrieving the drill string from the well. The valve assembly is particularly useful when drilling into deep coal beds that contain methane gas. The use of air as a drilling medium avoids having to utilize liquid drilling fluids, which tend to encroach into and damage such formations. The valve is easily moved between open and closed positions by manipulating the drill string. The valve can be retained in either the open or closed position.--

Signed and Sealed this

Twenty-sixth Day of December, 2006

JON W. DUDAS
*Director of the United States Patent and Trademark Office*